US008347464B2

(12) United States Patent
Bagshaw et al.

(10) Patent No.: US 8,347,464 B2
(45) Date of Patent: Jan. 8, 2013

(54) DEVICE FOR PROCESSING COTTON

(75) Inventors: Kevin Michael Bagshaw, Bell Park (AU); Stuart Geoffrey Gordon, Jan Juc (AU)

(73) Assignee: Commonwealth Scientific and Industrial Research Organisation, Campbell, ACT (AU)

( * ) Notice: Subject to any disclaimer, the term of this patent is extended or adjusted under 35 U.S.C. 154(b) by 196 days.

(21) Appl. No.: 12/732,919

(22) Filed: Mar. 26, 2010

(65) Prior Publication Data

US 2010/0242229 A1 Sep. 30, 2010

(30) Foreign Application Priority Data

Mar. 26, 2009 (AU) ..... 2009901314

(51) Int. Cl.
*D01B 1/04* (2006.01)

(52) U.S. Cl. ..... 19/62 R; 19/62 A

(58) Field of Classification Search ..... 19/62 R, 19/62 A

See application file for complete search history.

(56) References Cited

U.S. PATENT DOCUMENTS

| | | | | | |
|---|---|---|---|---|---|
| 206,847 | A | * | 8/1878 | Williams | 19/62 R |
| 268,007 | A | * | 11/1882 | Garlington | 19/62 R |
| 417,849 | A | | 12/1889 | Abernethy | |
| 471,849 | A | | 12/1889 | Abernethy | |
| 510,073 | A | * | 12/1893 | Lemain | 19/62 R |
| 1,851,977 | A | | 4/1932 | Cumpston | |
| 2,055,573 | A | | 9/1936 | Cordell et al. | |
| 4,850,083 | A | | 7/1989 | France | |
| 5,979,018 | A | * | 11/1999 | Albus et al. | 19/62 R |

FOREIGN PATENT DOCUMENTS

| | | |
|---|---|---|
| SU | 1513040 | 10/1989 |
| SU | 1534106 | 1/1990 |
| SU | 1534107 | 1/1990 |

* cited by examiner

*Primary Examiner* — Shaun R Hurley
(74) *Attorney, Agent, or Firm* — Merchant & Gould P.C.

(57) ABSTRACT

The present invention relates to a rib insert, a ginning rib and process for a ginning seed-cotton. The insert and ginning rib have an outer profile so that seed-cotton in contact therewith is urged away from the ginning zone formed between the ginning rib and saw. Advantages of the invention include increasing the rate of lint removal during ginning and increasing the long fiber length compared to conventional ginning.

42 Claims, 11 Drawing Sheets

DEVICE FOR PROCESSING COTTON

This application claims benefit of Serial No. 2009901314, filed 26 Mar. 2009 in Australia and which application is incorporated herein by reference. To the extent appropriate, a claim of priority is made to the above disclosed application.

FIELD OF THE PRESENT INVENTION

The present invention relates to a ginning rib, an insert for a gin rib, a gin stand with a saw for processing cotton fibre and a method of ginning cotton fibre.

BACKGROUND OF THE PRESENT INVENTION

The present invention is applicable to modern saw-gins which are highly automated and productive systems that incorporate many processing stages besides the removal of fibre from seed-cotton.

For instance, typical operation of a modern saw-gin involves opening a module of seed-cotton weighing between 10 and 20 tonnes by a bank of beaters; the seed-cotton is then transported by air through a drying tower that dries the seed-cotton to a moisture level that ensures efficient trash removal. The seed-cotton may be pre-cleaned to remove sticks, stones and unopened bolls before proceeding to a gin stand. At the gin stand, lint is separated from the seed and transported by air to one or two lint cleaners for further cleaning. Following lint cleaning the lint is transported to the battery condenser and the bale press for pressing into a bale.

The roll box of a gin stand is where the actual ginning process, i.e. the separation of cotton fibre (lint) and seed, takes place. The ginning action is caused by multiple circular saws set on a shaft rotating between gin ribs, which are located approximately 1 mm from the saws. The teeth of the saw rake a seed-roll, which is formed in the roll box where in-coming seed-cotton is accumulated. The teeth of the saws pick and hold the fibre on seed-cotton and pass it between the gin ribs at a ginning or gin point or working zone which is substantially adjacent to the saw teeth. The gin point is a zone defined between the leading edge of the saw teeth and the gin rib. At this point the saw teeth pull the lint from the seed, which is too large to pass through the gap between the gin rib and saw, thereby separating the cotton fibre from the seed.

The ginning rib and in particular, the outer face of the ginning rib at the gin point or working zone, which is essentially a planar outer face, is subjected to significant wear and tear. In order to minimize the frequency at which the ginning ribs need replacing, sacrificial inserts or wear plates may be added to the ginning rib at the ginning zone. Like traditional one piece ginning ribs, the inserts also have a planar outer face.

SUMMARY OF THE PRESENT INVENTION

The present invention has arisen through the realisation that production rates of cotton gins are restricted by denuded or fuzzy seed becoming wedged between the ginning rib and rotating saws that prevents other seed-cotton from accessing the ginning point or zone. This wedge effect can also cause damage to the seed and fibre that can result in an overall reduction in the quality of the fibre produced.

It is an object of the present invention to provide an improved ginning rib, an insert for a ginning rib, an improved gin stand, and a method for ginning cotton fibre that can alleviate these issues.

The present invention also relates to an insert having a body that may be fixedly or removeably mounted to a ginning rib at a high wear working zone on the ginning rib, the insert or the body of the insert including:

i) side edges that extend along at least part of the length of the body; and ii) an outer face that has one or more than one guiding surfaces that extend above or below the outer face and are configured to extend in a direction inwardly of the side edges of the working zone, such that when in use, particles such as fuzzy seed or debris can be guided away from the side edges of the insert toward a central axis of the outer face.

In an embodiment, whereby when the insert is mounted to the ginning rib which is itself operatively mounted to a ginning apparatus, the outer face of the insert has a leading portion and a trailing portion relative to a direction of rotation of saws of a ginning apparatus, and the outer face of the insert has a wall section disposed between the leading portion and trailing portion so that the particles moving in a direction from the leading portion toward the trailing portion can contact the wall section and be guided away from the side edges.

Throughout this specification it will be appreciated that the term "working zone" embraces a region of the ginning rib or an insert of the ginning rib that is subject to high wear and is located near, adjacent to, or overlaps with the teeth of rotating saws. In other words, the working zone includes or overlaps with a ginning point or ginning zone that is defined between the ginning rib and the rotating saws.

Throughout this specification the term "seed-cotton" has been used to mean a seed still having the cotton lint attached and seeds that are yet to be processed in a ginning process i.e., substantially all lint remains. The terms "cotton seed" or "fuzzy seed" embrace seeds that have undergone a ginning process in which a portion, a substantially portion, or close to all of the cotton lint has been removed.

The present invention relates to a ginning rib for use in a gin stand having rotating saws, cotton lint being separated from seed-cotton over a ginning zone, or at a ginning point defined between the ginning rib and the saws, the ginning rib including:

i) a elongate body that can be operatively mounted to the gin stand between adjacent rotating saws of a gin stand; and ii) a working zone that has an outer face, side edges, and one or more than one guiding surfaces that extend above or below the outer face, the guiding surfaces are configured to extend in a direction inwardly of the side edges of the working zone, and when the ginning rib is in use, the guiding surface(s) can guide particles such as seed-cotton or fuzzy seed in a direction away from the side edges toward a central region or axis of the ginning rib.

In an embodiment, when the ginning rib is in use the working zone of the ginning rib has a leading portion and a trailing portion relative to the direction of rotation saw, and wherein the guiding surface is disposed between the leading and trailing portions and has a different level to a level of the leading portion such that the particles moving from the leading portion toward the trailing portion can contact the guiding surface and be guided away from the side edges of the working zone.

The present invention also relates to a ginning rib for use in a gin stand having rotating saws, the ginning rib including:

i) an elongate body that can be operatively mounted to a gin stand between adjacent rotatable saws of a gin stand; and ii) a working zone on the body at a high wear region of the ginning rib, the working zone having an outer face and side edges, and when the body is fastened in an operative position to the gin stand, the working zone has a leading portion and a trailing portion relative to the direction of rotation of the saw, and wherein the outer face of the working zone has one or more than one guiding surfaces that extend above or below the outer face and are configured to extend in a direction inwardly of, or inwardly from, the side edges of the working zone so that particles, such as fuzzy seed or debris moving from the leading portion in a direction toward the trailing portion can be guided away from the side edges toward a central axis or region of the working zone by the guiding surface.

The working zone may be cast from the same or different material to the material of the elongate body.

The present invention also relates to an insert having a body that may be fixedly or removably mounted to a ginning rib at a high wear working zone on the ginning rib, the insert including:

i) side edges that extend along at least part of the length of the elongate body; and ii) an outer face which when the insert is fastened to the ginning rib has a leading portion and a trailing portion as viewed from the direction of rotation of a saw, and wherein the outer face also has one or more guiding surface that is disposed between the leading portion and the trailing portion, and the guiding surface extend above or below the outer face and are configured to extend in a direction inwardly of, or inwardly from, the side edges of the working zone such that particles such as fuzzy seed or debris, moving in direction from the leading portion toward the trailing portion are guided away from the side edges toward to central region or axis of the insert by the guiding surface.

In an embodiment, the guiding surfaces include a wall section that protrudes above and/or are recessed below the outer face. Suitably, the wall section defines a recess in the form of a groove or grooves or defines a raised ridge or ridges.

In an alternative embodiment, the guiding surfaces may be in the form a depression spaced from the side edges. The depression may be symmetric or asymmetric about a central axis but is in any event recessed compared to the side edges.

In an embodiment, it is possible that the insert may be cast from different material to the main body of the ginning rib, yet integrally connected thereto.

In an alternative embodiment, the insert may be removably attached to the ginning rib, thereby enabling the insert to be replaced with a fresh insert as required. Suitably, the insert includes one or more than one attachment element or formation associated with the insert for fastening the insert to the ginning rib. The removable insert may be made of any material including metals, plastics, ceramics that are different or the same as the material of the ginning rib.

In the situation in which the working zone is integrally formed with the ginning rib, the outermost planar surface is continuous with regions of the ginning rib adjacent to the working zone. In the alternative situation in which the working zone is formed by a replaceable insert, the leading portion and/or trailing portion of the insert may be continuous with adjacent sections of the ginning rib when fitted thereto. Alternatively, either one of both of the leading and trailing portions may be discontinuous with adjacent sections of the ginning rib.

In an embodiment, the wall section protrudes to a varying height, or is recessed to a varying depth relative to the outer face of the working zone.

In an embodiment, the guiding formation, wall section or groove may have a varying or non-uniform width. For example, the width may have a maximum width of equal to, or less than 10 mm.

In an embodiment, the wall section of the guiding surface is in the form of a V-shape in which the apex of the V-shape points toward the trailing portion. Suitably, the diverging legs of the V-shape extend to the side edges.

In an embodiment, the wall section of the guiding surface has a level that is different to the level of a leading portion.

In an embodiment, the wall section extends above the surface of the leading portion and/or the trailing portion.

In an embodiment, the wall section extends below the surface of the leading portion and/or the trailing portion.

In an embodiment, the difference in levels between the wall section and the remainder of the outer face reduces such that the wall section is substantially planar with the outer face. For example, in the situation in which the wall section has a V-shape, the depth of the wall section may effectively diminish at the apex.

In an embodiment, the wall section is formed by a groove or channel that extends below the leading portion. The groove or channel may have a substantially constant depth or uniform depth. Alternatively, the groove or channel may have a varying or non-uniform depth. For example, the groove or channel may reduce in depth in a direction toward the central zone or axis of the working zone.

In another example, the groove or channel reduces in depth from the side edges to a central zone or axis.

In an embodiment, the depth of the groove or channel has a depth that is equal to, or less than 10 mm, and suitably less than 5 mm.

In an embodiment, the groove or channel has at least one of: a flat bottom wall, a curved bottom wall, or pointed bottom defined by two walls converging.

In an embodiment, the leading portion is an essentially planar surface.

In an embodiment, the trailing portion is also essentially planar.

In an embodiment, the leading portion and trailing portion may be substantially co-planar. In an alternative embodiment, the leading portion and trailing portion may be substantially non-planar.

It is within the scope of the present invention that the wall section may include one or more than one of the grooves, channels or wall sections that protrudes above or below the leading or trailing portions.

The guiding surface may include any means for guiding the particles such as frictional means including low profile barbs or teeth that resist movement of particles toward the side edges, but allow movement of the particles away from the side edges toward the centre of the ginning zone.

The present invention also relates to a gin stand including:

i) a frame assembly;

ii) a plurality of saws that are rotatably mounted to the frame assembly about a common axis, wherein the saws are spaced from one another in adjacent relationship; and iii) a plurality of ginning ribs of which at least one includes, and suitably all of each include, a working zone having any one or combination of the features of the working zones described above.

The present invention also relates to a gin stand including:

i) a frame assembly;

ii) a plurality of saws that are rotatably mounted to the frame assembly about a common axis, wherein the saws are spaced from one another in adjacent relationship; and iii) a plurality of ginning ribs of which at least one includes, and suitably all of each include an insert having any one or combination of the features of the inserts described above.

The present invention also relates to a method of ginning seed-cotton in a ginning apparatus including a frame assembly, a plurality of saws that are rotatably mounted to the frame assembly about a common axis and are spaced from one another in adjacent relationship, and a plurality of ginning ribs of which one is located between some or all of the saws and in which the ginning ribs have a working zone at a high wear region of the ginning rib, the working zone having an outer face and side edges, the outer face of the working zone has one or more than one guiding surfaces that extend above or below the outer face and are configured to extend in a direction inwardly of, or inwardly from, the side edges, and wherein the method includes:

a) feeding seed-cotton onto the saws of the cotton gin;

b) rotating the saws so that cotton lint of the seed-cotton is caught by the saw, and the seed-cotton is pulled toward the ginning rib for removing cotton lint from the seed-cotton;

c) allowing the seed-cotton to engage the guiding surfaces of the ginning ribs which urge the seed-cotton away from the side edges of the ginning ribs; and d) collecting the cotton lint separate.

In an embodiment, the seed-cotton engages the guiding surfaces and moves in a direction away from the side edges of the working zone while the cotton lint is being removed from the seed-cotton during rotation of the saws.

In an embodiment, the working zone has a leading portion and a trailing portion relative to the direction of rotation of the saw, and the seed-cotton moves in a direction away from the side edges of the working zone while moving in a direction from the leading portion to the trailing portion.

In an embodiment, the working zone may be a zone that is integrally formed with the rib or, alternatively, the working zone may form part of a removable insert.

The method of the present invention may be applied to any cotton fibre type including long and short Upland (*Gossypium hirsutum*) cottons which account for approximately 90% of the total cotton grown globally.

When the seed-cotton is Upland seed-cotton, an embodiment of the method of the invention includes removing more cotton lint from the seed-cotton so that less residual lint remains on the fuzzy seed after one pass through the ginning apparatus. Typically, we have found that the method of the invention can remove 0.5% more cotton lint by weight compared to conventional methods in which standard ginning ribs or rib inserts are used. The term "residual lint" as used herein is a mass ratio (usually as a percentage) of the lint remaining on the denuded seeded cotton (fuzzy seed) to the total weight of the denuded seeded cotton.

We have found that the residual lint percentage on the fuzzy seed using the invention is at least 0.5% by weight less than the residual lint percentage using a conventional ginning rib or insert (i.e., without a guiding formation), and suitably at least 1.0 to 1.5% by weight less. In a preferred embodiment, the residual lint percentage is decreased by 0.5% to 1.5%, or 0.5% to 2.0%, relative to using a conventional ginning rib or insert.

In an embodiment, less than 10.9 wt %, and even more suitably less than 10.7 wt %, and yet even more suitably approximately 10.5 wt % residual lint remains on the fuzzy seed. In a preferred embodiment, the residual lint percentage is in the range 10.5% to 10.9%.

We have found that the mean long length of the fibre removed from the seed-cotton is typically longer, by an amount of 0.02 inches (0.51 mm), than the mean long length of fibre using a conventional ginning rib or insert (i.e., without a guiding formation). In a preferred embodiment, the mean long fibre length is increased by 0.01 inches to 0.04 inches relative to using a conventional ginning rib or insert. It will be understood that the term "mean long length" of fibre is an average fibre length of the upper half or longest half of the fibres in a sample.

We have found that mean long fibre lengths of the present invention are at least 0.5% greater that the mean long fibre length produced using a conventional ginning rib or insert, and suitably at least 1.0 to 2.0% greater. In a preferred embodiment, the mean long fibre length is increased by 0.5% to 1.5%, or 0.5% to 2.0%, relative to using a conventional ginning rib or insert.

In an embodiment, the mean long fibre length may be greater than 1.07 inches (2.718 cm). Even more suitably, the mean fibre length is greater than 1.075 inches (2.731 cm). In a preferred embodiment, the mean long fibre length is 1.07 inches to 1.10 inches.

We have found, the length of fibre removed from the seed-cotton has a lower mean short fibre index the mean long length of fibre using a conventional ginning rib or insert (i.e., without a guiding formation). It will be understood that the term "short fibre index" of fibre is the average percent by weight of fibres in a sample with a fibre length less than ½ inches (12.7 mm).

We have found that the mean short fibre index of the present invention is at least 0.5% by weight less that the mean short fibre index produced using a conventional ginning rib or insert, and suitably at least 1.5 to 2.0% by weight less. In a preferred embodiment, the mean short fibre index is decreased by 0.5% to 2.0% relative to using a conventional ginning rib or insert.

Each of these changes was unexpected and could not have been predicted prior to testing the inserts. Each of the changes is highly significant in economic terms since each 0.1% change represents millions of dollars per year to the cotton industry. Each of the improvements described herein is understood to be relative to ginning of the same variety of cotton, ginned under the same conditions, but using a conventional ginning rib or insert.

The present invention also relates to a method of ginning seed-cotton in a ginning apparatus including a frame assembly, a plurality of saws that are rotatably mounted to the frame assembly about a common axis and are spaced from one another in adjacent relationship, and a plurality of ginning ribs of which one is located between some or all of the saws and in which the ginning ribs have a working zone at a high wear region of the ginning rib, the working zone having an outer face and side edges, the method including:

a) providing the outer face of the working zone with at least one guiding surface that extends above or below the outer face and is configured to extend in a direction inwardly of, or inwardly from, the side edges;

b) feeding seed-cotton onto the saws of the cotton gin;

c) rotating the saws so that cotton lint of the seed-cotton is caught by the saw, and the seed-cotton is pulled toward the ginning rib for removing cotton lint from the seed-cotton; and d) allowing the seed-cotton to engage the guiding surfaces of the ginning ribs which urge the seed-cotton away from the side edges of the ginning ribs.

It is within the scope of the present invention that the gap between the saws and ginning ribs may be any size. For instance, the gap may be up to 2 or 3 mm, or as little as 0.15 mm, and suitably in the range of 0.25 to 2.25 mm.

The present invention also relates to cotton lint produced by the method described herein.

BRIEF DESCRIPTION OF THE DRAWINGS

The present invention will now be described with reference to the accompanying drawings, of which.

DETAILED DESCRIPTION

Figure 1:
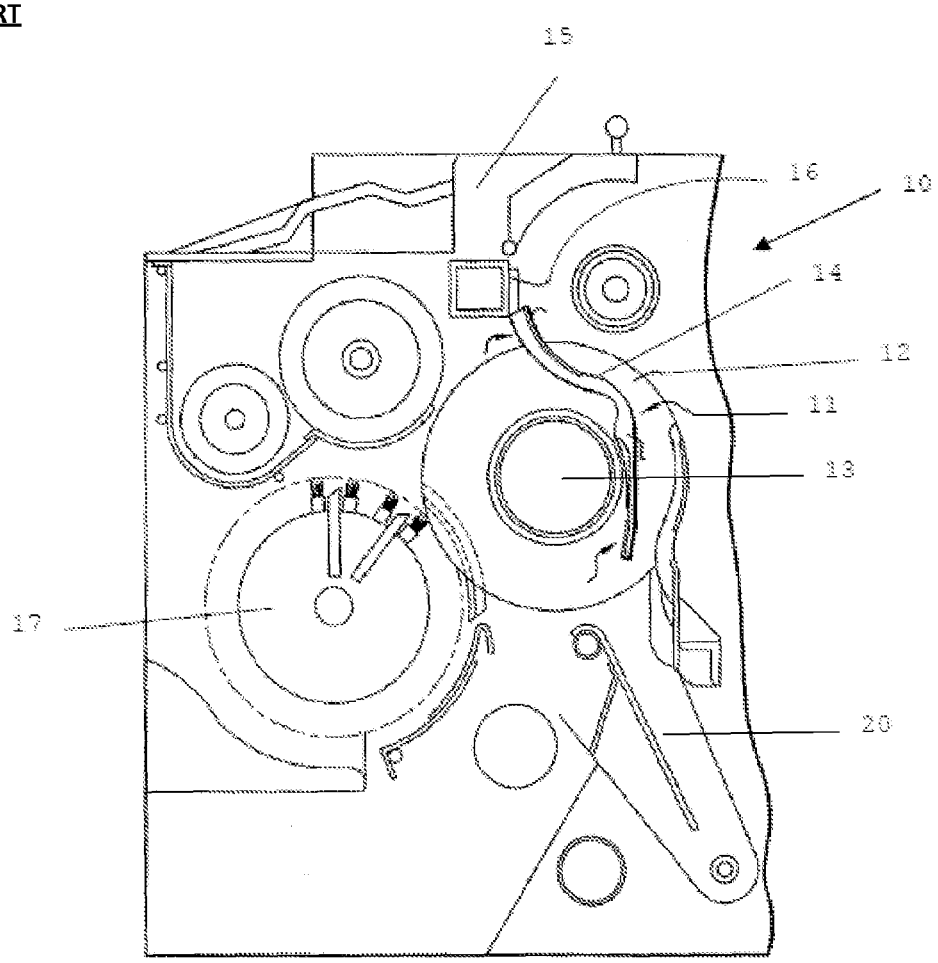
FIGURE 1 PRIOR ART
FIG. 1 is a schematic illustration of a conventional prior art gin stand.

FIG. 1 is a side view of a gin stand 10 comprising a rotating saw roller 11 having a series of equally spaced apart saws 12 that are rotatably driven about a common axis 13, a set of ginning ribs 14 that are fixed to a frame assembly 15 of the gin stand 10 at one attachment point 16 and a doffing roller 17 that removes lint from the saw 11. The ginning ribs 14 extend from the attachment point 16 above the saw 11 and curve downwardly between the saw blades 12. In the case of the embodiment shown in FIG. 1, the lower end of the ginning rib 14 is not fixed to a second attachment point.

Figure 2:
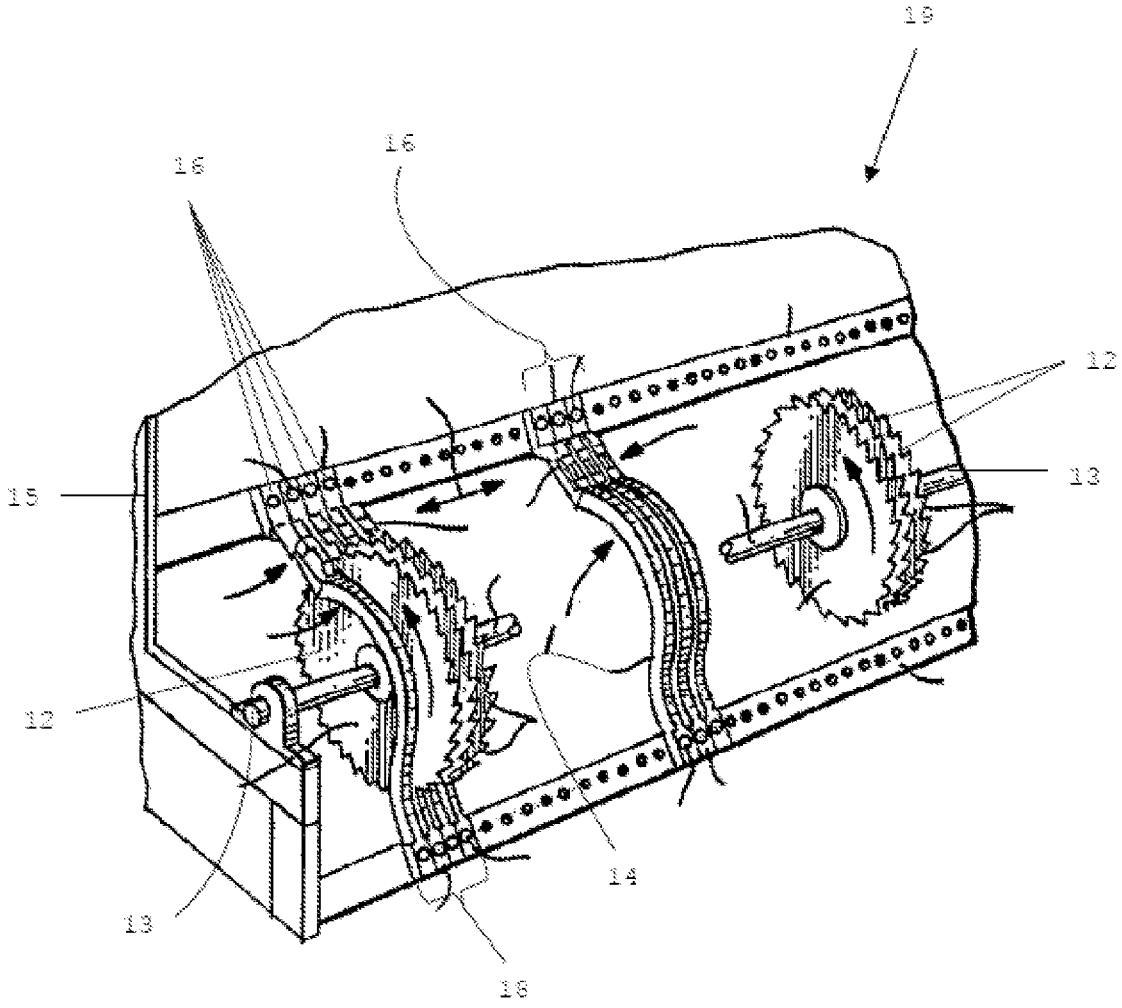
FIGURE 2 PRIOR ART
FIG. 2 is a perspective view of a partially assembled saw-gin roller box comprising a plurality of the saws and ginning ribs.

FIG. 2 illustrates a perspective view of a roller box 19 of gin stand in which the ginning ribs 14 are fixed to the frame assembly 15 at upper and lower attachment points 16 and 18 respectively and the direction of rotation of the saws blades 12. FIG. 2 clearly shows how the set of the ginning ribs 14 are arranged in a series between the saw blades 12. In operation, separation of cotton lint from seed-cotton takes place in the roller box 19 of the gin stand 10. Cotton fibre on the seed-cotton is caught by the teeth of the saws 12 and pulled toward the ginning ribs 14. At the upper end of the ginning ribs 14, the teeth of the saws 12 pass between adjacent ginning ribs 14 on either side. The ginning ribs 14 and saws 12 are separated by a gap and cotton fibre is pulled from the seed-cotton, by the teeth of the saw. The gap between the ginning rib 14 or the side edge of the insert set in the ginning rib and the saws 12 in this region is known as the ginning point or ginning zone. The seed-free cotton lint passes through the ginning point or zone and is removed from the saw teeth by the doffing roller 17. Seed free of cotton lint (fuzzy seed), or substantially free of the lint can fall downward between the ginning ribs 14 and the saws 12 and eventually onto a conveyor or lower chamber 20 (as shown in FIG. 1) and removed from the lint stand 10. Seed free of lint (fuzzy seed) can also be pushed into the centre of the seed roll and be expelled via a seed tube or auger from the seed roll. Partially de-linted seeds or seeds having long fibres thereon are generally pushed upward along the ginning rib 14 to undergo the ginning process yet again.

The gap between the gin ribs and the saws may be any suitable gap, for example, and without limitation, a gap in the range of 0.25 mm to 2.5 mm may be employed.

Figure 3:
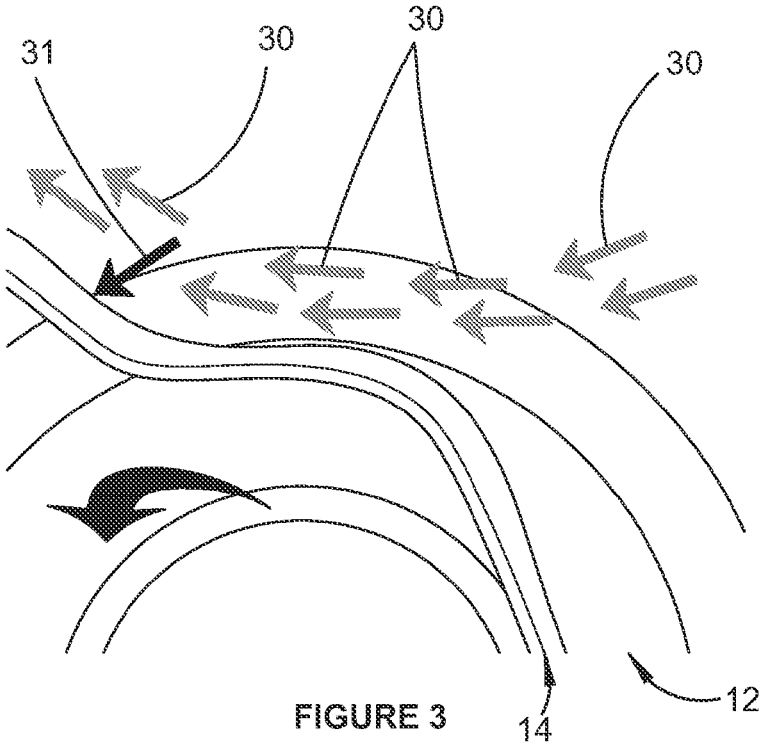
FIG. 3 is a schematic illustration showing a side view of a single ginning saw and ginning rib associated with the saw.

FIG. 3 is a schematic illustration of a side view of a saw 12 and a ginning rib 14. The arrows identified by reference numeral 30 show the general movement of seed-cotton having lint. The arrow 31 identifies the ginning point or zone at which the seed-cotton has the strands of fibre removed from the seed.

We have found that the production capacity of the ginning stand is limited by fuzzy seed becoming wedged between the ginning rib and the saw at the ginning zone. The wedging effect prevents access for other seed-cotton to the ginning zone. Furthermore, denial of access of seed-cotton can also result in damage of seeds which can cause broken seeds to travel between the saws and into lint cleaning stages downstream of the ginning stand 10.

To reduce the incidence of blockage of the ginning zone and, in turn, reduce the incidence of damage to fuzzy seeds and breakage of the cotton, we have devised an improved ginning rib or insert for a ginning rib.

Figure 4:
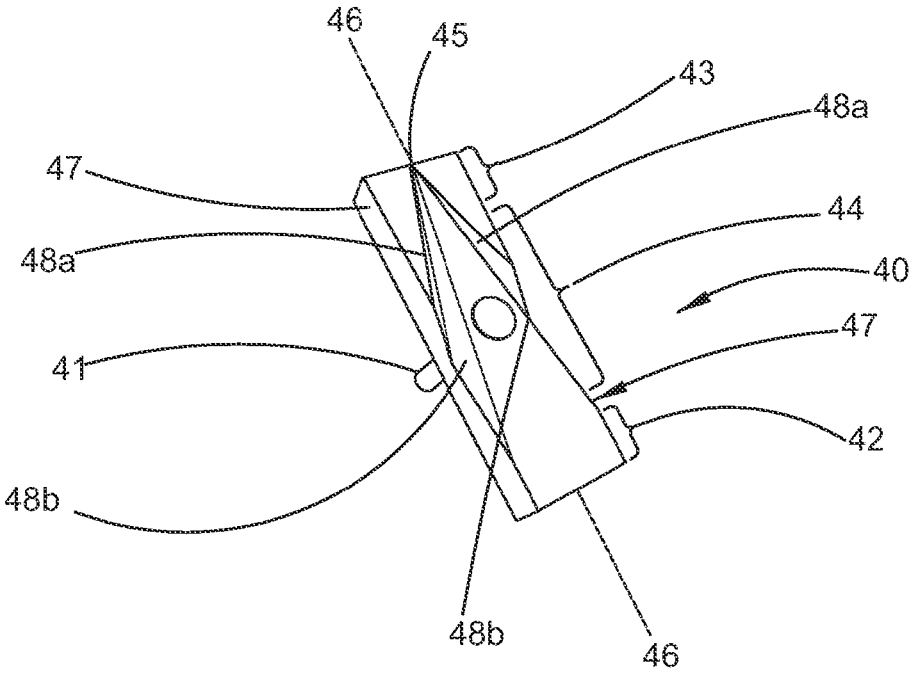
FIG. 4 is a photograph showing a perspective view of an insert for a ginning rib according to a preferred embodiment of the present invention.

The improvement comprises the ginning rib or insert for a ginning rib having a contoured outer face. FIG. 4 illustrates an example of an insert having a main body 40 and an attachment formation in form of a fastening stem or lug 41 that extends below the main body 40. A top surface of the fastening stem is seen flush with the outer face of the insert. When in use, a fastening stem is received by a opening in the ginning rib and is oriented such that the outer face of the insert is located at in an orientation that is non-perpendicular to a radial line from the axis of rotation of the saw, see FIG. 3. The orientation of the insert relative to the direction of rotation of the saw defines a leading portion 42 including a leading edge and a trailing portion 43 including a trailing edge that are separated by a guiding formation 44.

In the case of the preferred embodiment shown in FIG. 4, the leading and trailing portions 42, 43 respectively have flat planar surfaces that are substantially co-planar. However, this need not necessarily be the case. For instance the leading portion 42 may be recessed at a level below the surface of the trailing portion 43. When the insert is located in an in use or operative position on a ginning rib, the surface of the leading portion 42 is essentially continuous with the outer surface of the ginning rib 14.

The guiding formation 44 shown in FIG. 4 has a V-shape with an apex 45 that terminates at the top of the insert which is generally in line with the central longitudinal axis 46 of the insert. Moreover, the V-shape may be said to be locate intermediate or between the leading and trailing portions 42 and 43.

The V-shape is in the form of a groove or channel that is ground out of what is otherwise an essentially planar outer face between opposite side edges 47. The V-shape may have a flattened, rounded or sharpened bottom line that extends part way, or along the entire length of the V-shape. In the case of the embodiment shown in FIG. 4, the bottom is defined by two converging wall sections 48*a* and 48*b*. In addition, the depth of the V-shape reduces or tapers from side edges 47 of the insert to the apex 45 at the top of the insert. Moreover, the depth of V-shape reduces to zero or negligible at the apex 45.

The wall sections 48*a*, 48*b* also define the width of the groove of the V-shape. The width also reduces or tapers from its widest point at the side edges 47 of the insert to the narrowest point of the groove at or approaching the apex 45.

The V-shape may be symmetrical or asymmetric about the apex 45. Similarly, the wall sections 48*a*, 48*b* that converge to form the base or bottom line of the groove may also be symmetric or asymmetric about the bottom line. In the case of the embodiment shown in FIG. 4, the wall sections 48*a*, 48*b* are symmetrical, however, the wall sections 48*a* adjacent to the leading portion 42 may appear to have less gradient than the opposed wall section 48*b* on account, merely the wall sections 48*b* extends further than wall section 48*a*.

Figure 5:
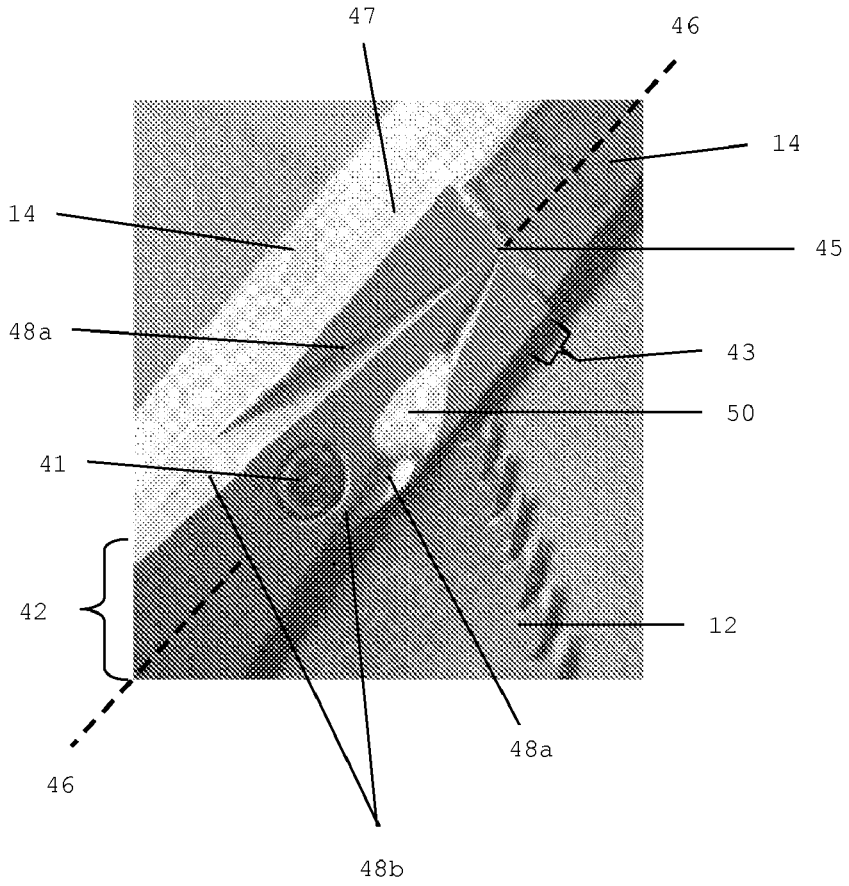
FIG. 5 is a photograph of the insert shown in FIG. 4 in which the insert has been fitted to a ginning rib and is shown in relation to the saw of a saw-gin roller box and a fuzzy seed located on the insert.

FIG. 5 is a photograph that shows the insert of FIG. 4 fitted to a ginning rib 14 and with the ginning rib 14 located in a position relative to one saw 12. As can be seen, the trailing portion 43 of the insert is essential planar or continuous with the ginning rib 14. The leading portion 42 would likewise be planar with the ginning rib 14.

As can be seen, the V-shaped formation is adapted to receive a fuzzy seed 50. In particular, when in the use, the fuzzy seed 50 moving from the leading portion 42 of the insert toward the trailing portion 43 can be received by the V-shaped formation so as to move the fuzzy seed 50 away from the side edges 47 of the insert and, in turn the ginning point or zone between the ginning rib 14 and the saw 12. In other words, the V-shaped formation guides the fuzzy seed 50 toward the central region or axis 46 of the insert while the fuzzy seed 50 is in the ginning zone. We have found that configuring the insert in this manner reduces the incidence at which fuzzy seeds can become wedged or jammed between the ginning rib 13 and the saw 12 at the ginning zone.

In other words, material travelling along the ginning rib 14 at the ginning zone is directed away from the edges 47 of the ginning rib 14. The benefits of this effect are numerous. For example, the present invention can: i) open up the ginning zone improving fibre transfer and reducing the natural tendency for the saw to pull the fuzzy seed down into the ginning zone which 'wedges' fuzzy seeds in the space between the saw and ginning point, ii) reduce the incidence of damage to cotton, iii) reduce the incidence of the fuzzy seed being broken which can result in the broken fuzzy seed passing between the ginning rib and the saw and into the lint separated from the seed, iv) enables more seed-cotton to access the ginning zone on account that fewer fuzzy seeds become wedged between the ginning rib and the saw.

FIGS. 11 to 16 illustrate examples of inserts according to alternative embodiments. The inserts have a main body 40 and an opening for an attachment formation such as a fastening stem or lug 41 (not shown in FIGS. 11 and 12). Like the embodiment shown in FIGS. 4 and 5, the inserts of FIGS. 11 to 16 have a leading portion 42 and a trailing portion 43 that are defined by the direction of rotation of ginning saws.

The leading and trailing portions 42, 43 of the alternate embodiments are substantially co-planar. However, this need not necessarily be the case. For instance the leading portion 42 may be recessed at a level below the surface of the trailing portion 43. Although not illustrated, when the insert is located in an in use or operative position on a ginning rib, the surface of the leading portion 42 is essentially continuous with the outer surface of the ginning rib 14.

Figure 11:
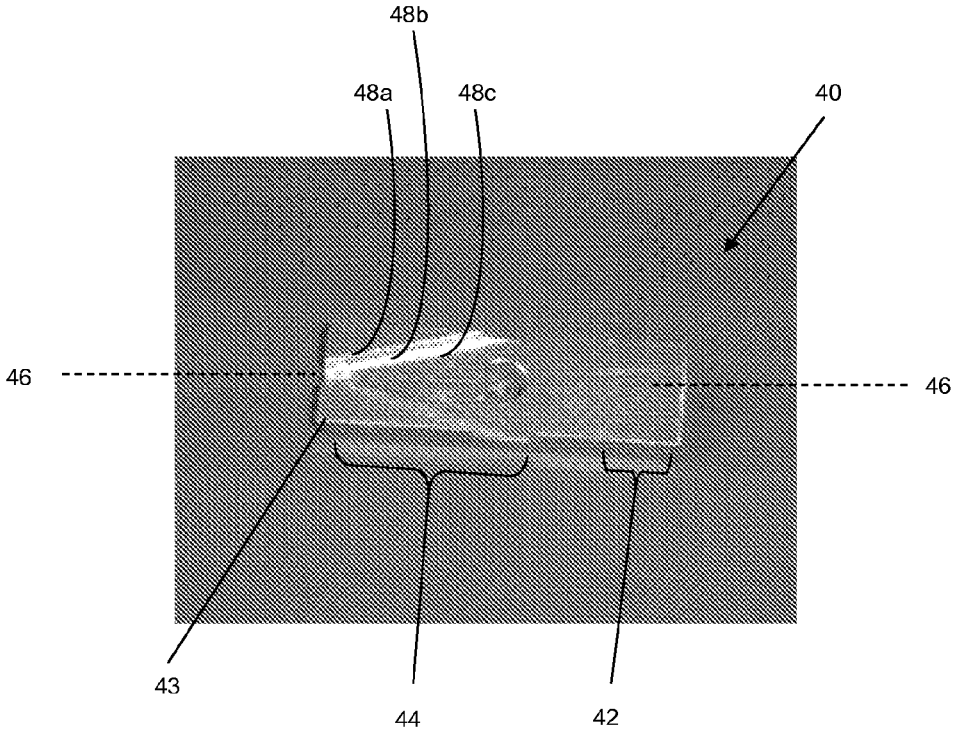
FIGS. 11 and 12 are photographs showing perspective views of an upper face of two inserts for a ginning rib according to alternative embodiments.

In the case of the embodiment shown in FIG. 11 the insert has a guiding formation 44 in the form of a V-shape in the form of a groove or channel. The groove includes wall sections 48*a* and 48*c* that extend essentially perpendicularly downward to the trailing and leading portions 43 and 42, and includes a bottom wall section 48*b* that defines a substantially flattened bottom. The depth of the groove is substantially uniform and extends from opposite side edges of the insert to a trail edge of the trailing portion of the insert. As can be seen, the groove forms a cutout in the trailing edge of the insert that is located on the longitudinal axis 46.

Figure 12:
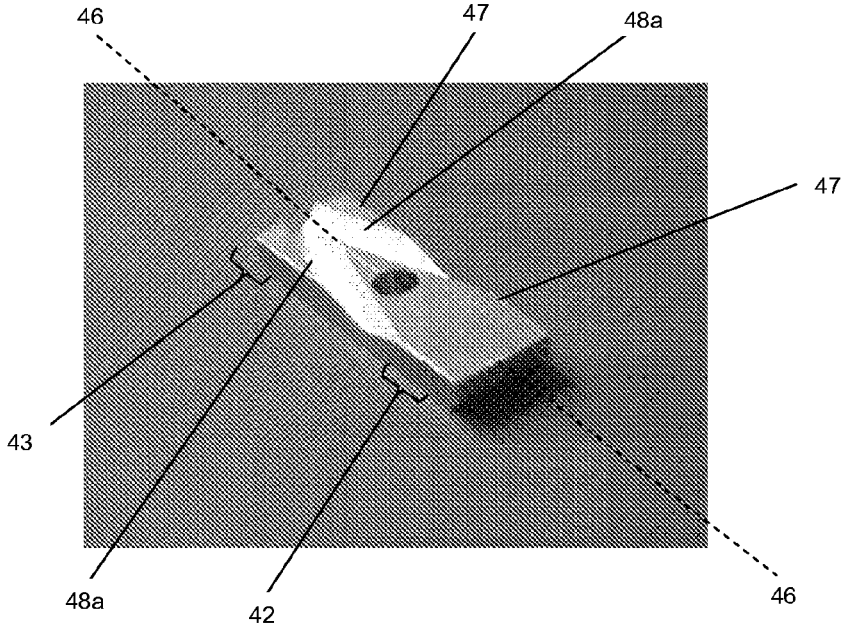

In the case of the embodiment shown in FIG. 12, the insert has a guiding formation 44 in the form of a V-shaped groove or channel. The groove includes wall sections 48*a* and 48*c* that converge to a point at the bottom of the groove. The depth of the groove is substantially uniform and extends from opposite side edges of the insert to a trail edge of the trailing portion of the insert. As can be seen, the groove extends into the trailing edge of the insert to form a cutout on the longitudinal axis 46.

Figure 13:
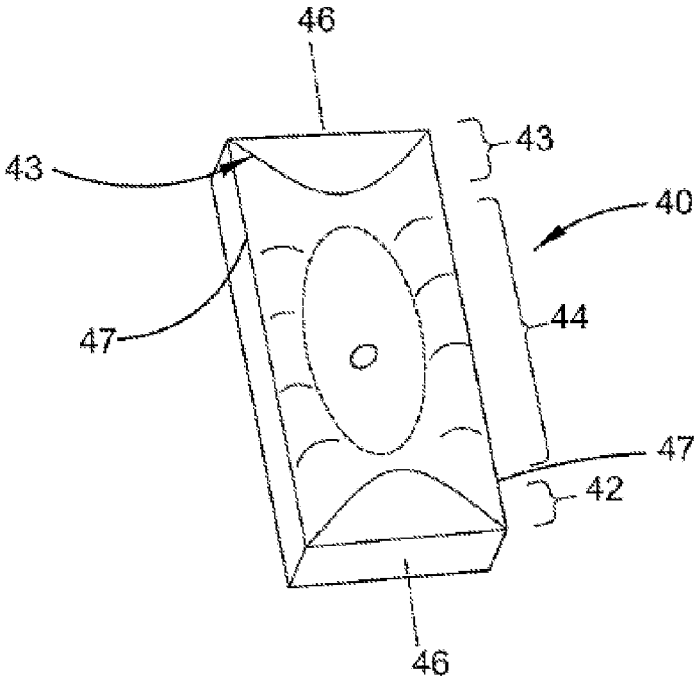
FIGS. 13 and 15 are schematic illustrations of an upper face of two inserts for a ginning rib according to further alternative embodiments.
Figure 14:
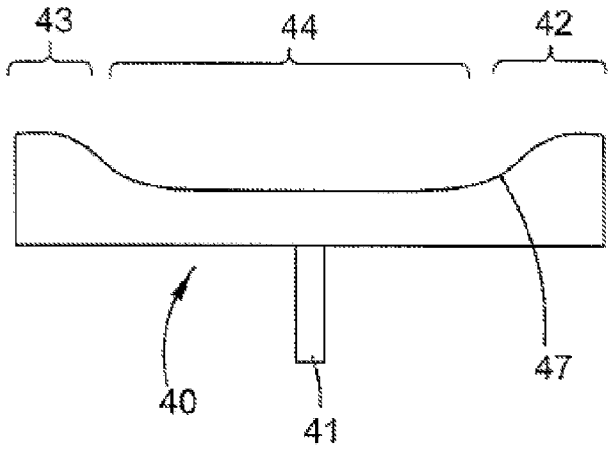
FIGS. 14 and 16 are cross-sectional views of the inserts along an axis line 46 shown in FIGS. 13 and 15 respectively.

In the case of the embodiment shown in FIGS. 13 and 14, the guiding formation 44 is in the form of depression that is spaced from the side edges 47 and spaced from the trailing and leading edges of the insert. The depression is centrally located about the longitudinal axis 46 and is located between substantially equally sized trailing and leading portions 42 and 43.

Figure 15:
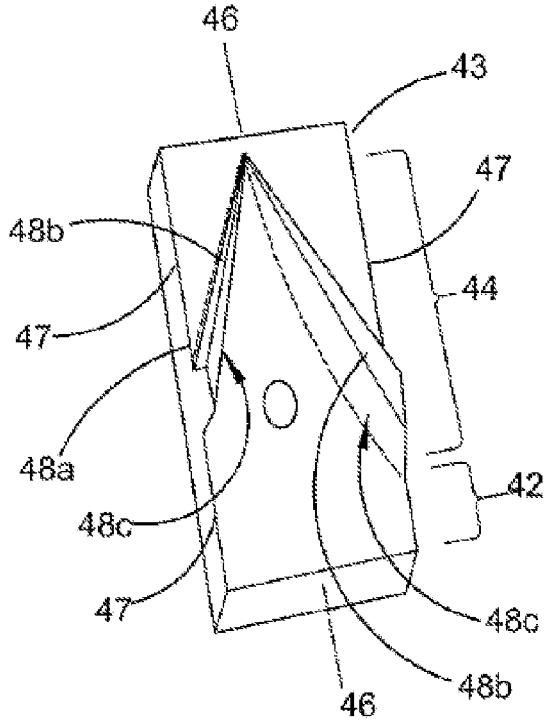
Figure 16:
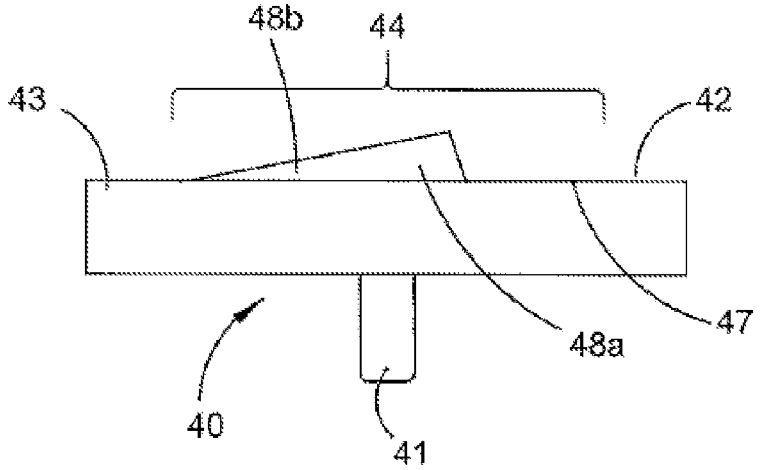

FIGS. 15 and 16 illustrate yet another alternative insert in which that guiding formation 44 is in the form of a ridge that protrudes above leading and trailing portions 42 and 43. The ridge is in the form of a V-shape and includes wall sections 48*a* and 48*b* that extend upwardly of the face of the insert. The wall sections 48*a* and 48*b* are interconnected by a wall section 48*b* that defines a flattened outer surface on the ridge. As can be seen in FIG. 15, the width of the ridge is at a maximum at the side edges 47 of the insert and reduces to a minimum or negligible height at the axis 46. In addition, as can be seen in FIG. 16, the height of the ridge decreases from the side edges 47 toward the axis 46.

Figure 17:
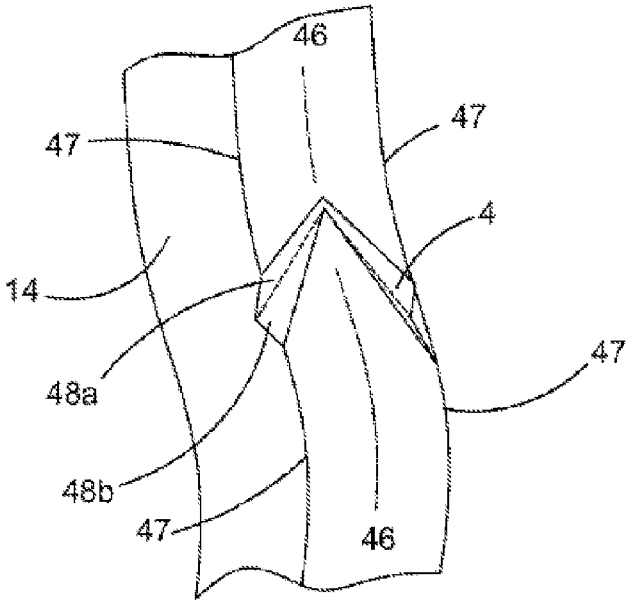
FIGS. 17 and 18 are perspective views of a working zone of a ginning rib have guiding formations according to alternative embodiments.
Figure 18:
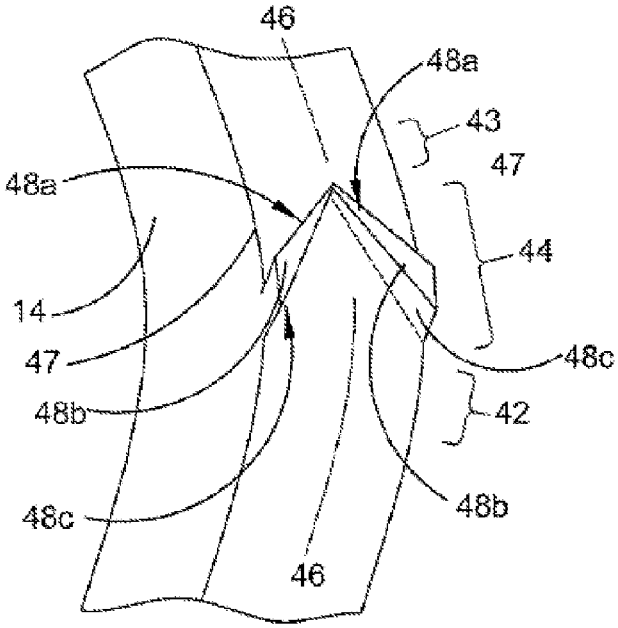

FIGS. 17 and 18 illustrate a working zone portion of a ginning rib 14 according to an embodiment. The ginning rib 14 has an elongate body with side edges 47 at the working zone. The working zones define a guiding formation 44 for guiding seed-cotton away from the side edges 47 when in use. In case of the embodiment shown in FIG. 17, the guiding formation is in the form of a V-shaped groove that extends from the side edges 47 inwardly toward a longitudinal axis 46. The groove is defined by converging wall sections 48*a* and 48*b* that join at the bottom of the groove. The depth of the V-shaped groove is non-uniform and specifically, decreases in depth from the side edges 47 toward the axis 46. When the ginning rib 14 is in use, the direction of rotation of saws (not shown) defines leading and trailing portions 42 and 43 either side if the V-shaped groove.

In case of the embodiment shown in FIG. 18, the guiding formation 44 is in the form of a V-shaped ridge that extends from the side edges 47 inwardly toward a longitudinal axis 46. The ridge is defined by wall sections 48*a* and 48*c* that protrude from the face of leading and trailing portions 42 and 43. An outer face 48*b* is a flattened outer surface that joins the wall sections 48*a* and 48*c*. As can be seen, the width of the ridge reduces from a maximum at the side edges 47 to a longitudinally axis 46. Similarly, the height of the ridge also reduces from a maximum at the side edges 47 to a negligible height at the axis.

It is within the scope of the present invention that the guiding formation may be in the form of a ridge, crest or rib. For example, the ridge or crest may protrude above the leading and/or trailing portions. In another embodiment, it is also possible that the guiding formation may in the form of a triangular or diamond formation having an apex of reducing depth located toward the top of the insert. According to another embodiment, it is also possible that the guiding formation may be in the form of a depression or recess, such as an elongate depression that is displaced inwardly of the side edges of the insert.

The embodiments of the removable insert described above can be replaced with a fresh insert in the event of wear or failure of the insert. However, it will be appreciated that it is within the scope of the present invention that any guiding formation such as V-shaped formation for guiding seed-cotton or fuzzy seed away from the side edges of the ginning rib may be integrally formed with a ginning rib. In this situation, the guiding formation, and the leading and trailing portions of the ginning rib may made from the same material as the remainder of the ginning rib or, alternatively, made from material having a higher wear resistance than the remainder of the ginning rib.

It is also within the scope of the present invention that the removable insert be reversible and have guiding surfaces on opposite sides of the insert.

Method

Figure 10:
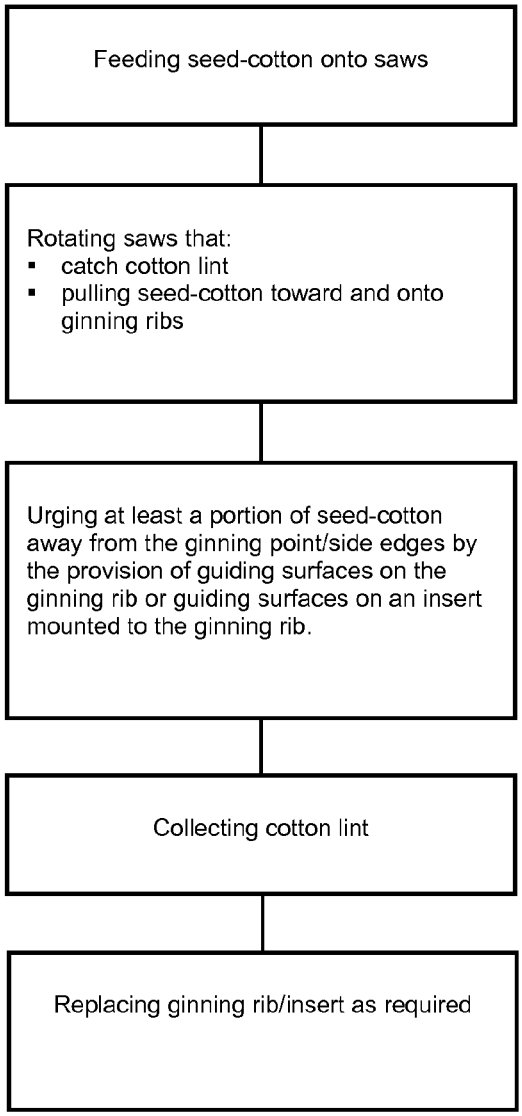
FIG. 10 is a block diagram showing steps of a method for ginning seed-cotton according to an embodiment of the invention.

A method according to an embodiment of the invention includes using of a rib insert or ginning rib that urges the seed-cotton away from the ginning point. With reference to FIG. 10, the method includes feeding seed-cotton onto a series of rotating saws of a gin stand. The saws are spaced apart and separated by ginning ribs that may include an insert having a guiding formation, for example, see the inserts shown in FIGS. 4, 5, and 11 to 16. Alternatively, the ginning ribs may have integrally formed guiding formations at the working zone, for example, see the ginning ribs in FIGS. 16 and 17. Lint of the seed-cotton is caught of the teeth of the rotating saws which pulls the seed-cotton toward and onto the ginning rib. The guiding formations of the ginning ribs, or inserts fitted to the ribs, contact the seed-cotton as the seed-cotton moves under the influence of the saws. Specifically, the working zone over which seed-cotton is delinted includes a leading portion as defined by the direction of rotation of the saws. As the seed-cotton moves over the working zone from the leading portion toward the trailing portion, the guiding surfaces urge the seed-cotton away from the gap between the ginning rib and the saws. For example, the guiding formation may guide the seed-cotton toward a central zone of the ginning rib. Lint separated from the seed-cotton may then be collected by a doffing roller or other suitable device.

Finally, the method may include replacing the rib inserts as the guiding formations thereon wear, or in the situation in which the guiding formations are integrally formed with the ginning ribs, the entire ginning rib may be replaced.

Trial

A rib insert having a guiding formation as shown in FIGS. 4 and 5, and a conventional insert without a guiding formation, have been tested and assessed. The test involved forming a ginning roll including ginning ribs having inserts with guiding formations on one half and the conventional inserts on the other half. Upland seed-cotton was feed onto the ginning roll which was operated at two separate production rates, notionally identified as 100 kw and 90 kw production rates in FIGS. 8 and 9. Samples of cotton lint separated from the seed-cotton were collected from opposite ends of the ginning roll. The properties of the lint separated and collected from the half of the ginning roll having the rib insert with the guiding formation (shown in FIGS. 4 and 5) is represented by the letters DRI (direction rib insert) in FIGS. 6 to 9, and the lint separated and collected from the half of the ginning roll having the conventional rib is the "Control" in FIGS. 6 to 9.

Samples of the fuzzy seed i.e., the seed after processing were also collected from opposite ends of the ginning stand.

Figure 6:
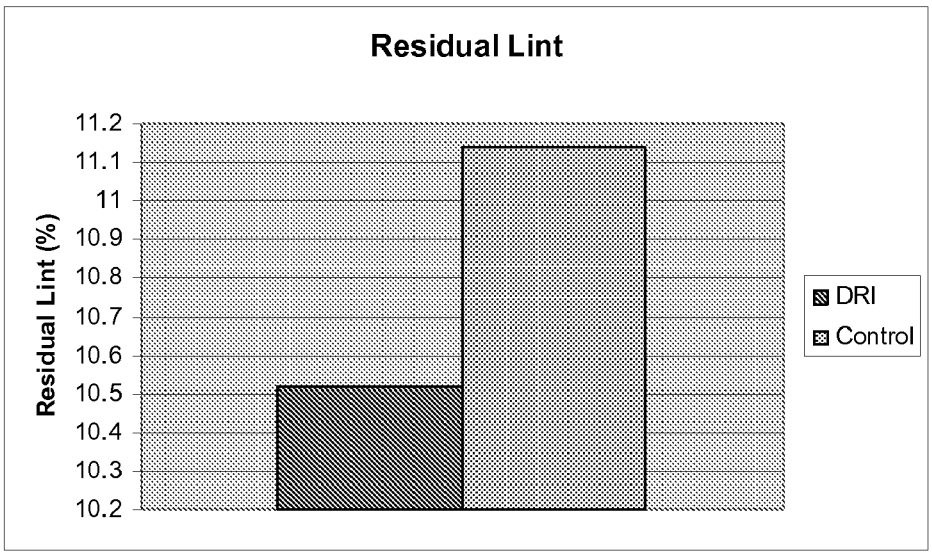
FIGS. 6 and 7 are graphs showing results of a trial in which the preferred embodiment of the rib insert shown in FIGS. 4 and 5 (i.e. Directional Rib Insert DRI), and a conventional rib insert with no outer profile (i.e. Control) were tested, the graph shows the amount of residual cotton lint on the seed.
Figure 7:
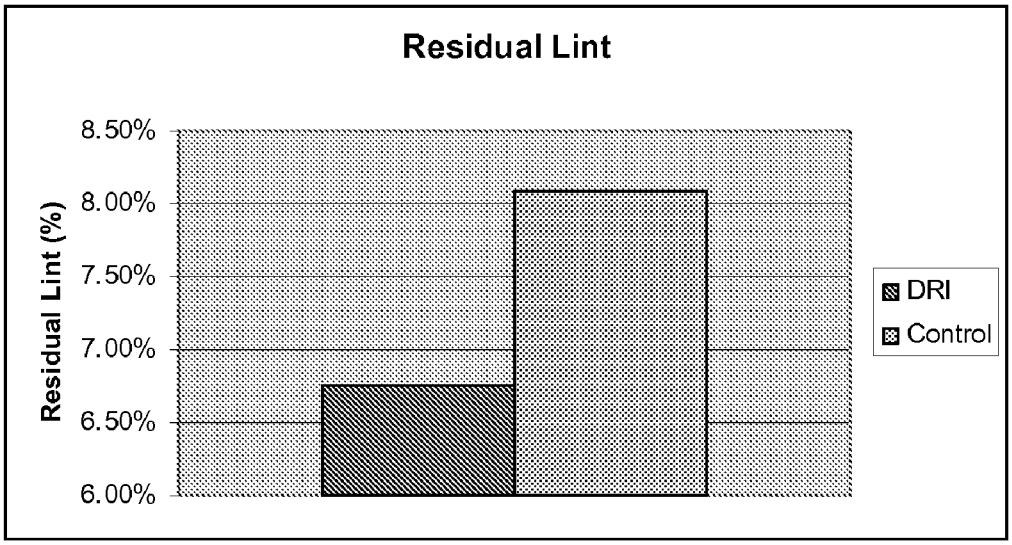

FIGS. 6 and 7 are graphical representations of guiding formations increasing the extent of separation of cotton lint and hence increasing yield compared that achieved using a conventional gin. Specifically, in the case of FIG. 6 residual lint on the fuzzy seed reduced from approximately 11.1% from the Control to approximately 10.5% using the DRI inserts. In the case of FIG. 7, residual lint reduced from approximately 8.1% for the Control to approximately 6.6% using the DRI inserts, i.e., a reduction of approximately 1.5%.

The greatest return to growers and ginners is in the ability to facilitate removal of more cotton lint from the seed. As shown by the trial, residual lint on fuzzy seed can be reduced by approximately 1%. In the past, an increase in ginning efficiency of 1% has only been achievable by constricting roll box dimensions, for example such as reducing the distance of the gap between the seed fingers and the ginning rib. However, reducing the dimensions between the dimensions in this way has a downside of creating more fibre damage, which in turn, reduces the length of the fibre separated.

Figure 8:
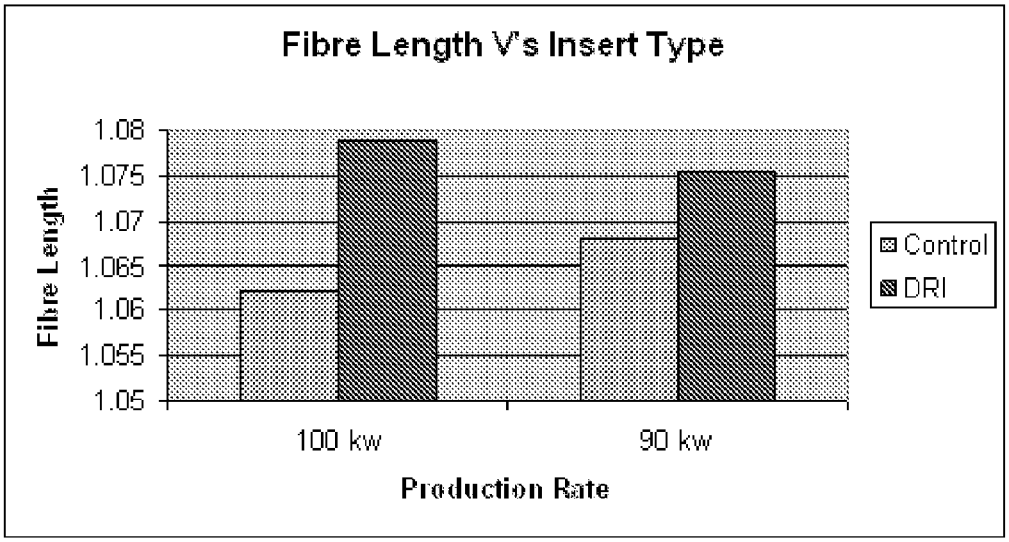
FIG. 8 is a graph showing results of the same trial of the preferred embodiment and Control, the graph shows Fibre Length at 2 production rates.
Figure 9:
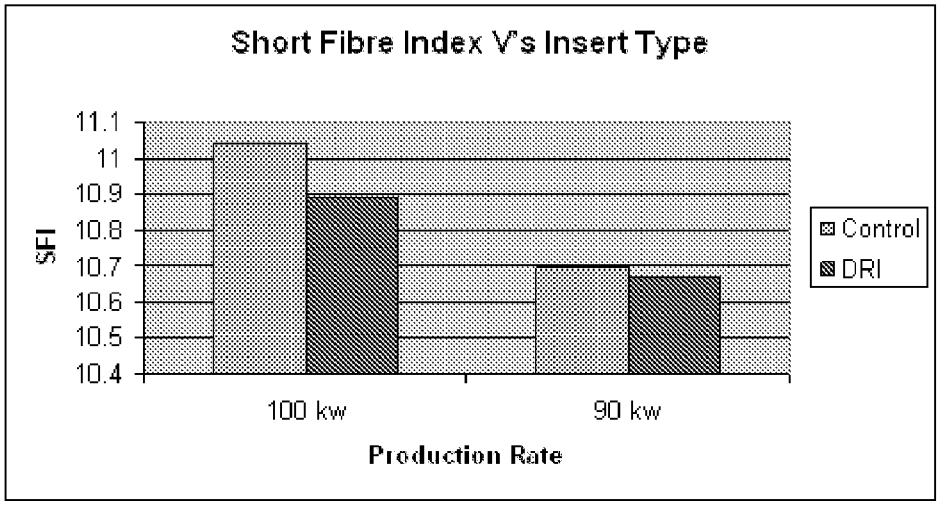
FIG. 9 is a graph showing results of the same trial of the preferred embodiment and the Control in terms of a Short Fibre Index at 2 production rates.

The trial conducted has shown that this is not a downside when using guiding formations. Moreover, FIG. 8 shows that the long fibre length of the sample of fibre actually increases to levels of approximately 1.078 inches and 1.075 inches for the two productions rates, whereas the fibre lengths produced for the Control (i.e., the conventional ginning rib) is approximately 1.062 inches and 1.068 inches respectively for the sample production rates and at the same spacing between the ginning ribs and the saws. Similarly, FIG. 9 shows that the short fibre index reduced to levels below 10.9 and 10.7, whereas the short fibre index for the conventional ginning rib i.e., the Control was approximately 11.04 and 10.7 at the sample production rates and at the same spacing between rib and insert.

Those skilled in the art of the present invention will appreciate that many variations and modifications may be made to the preferred embodiment without departing from the spirit and scope of the present invention.

The invention claimed is:

1. An insert having a body for fixedly or removeably mounting to a ginning rib at a high wear working zone on the ginning rib, the body of the insert including:

i) side edges that extend along at least part of the length of the body; and ii) an outer face that has at least one guiding surface that extends above or below the outer face and is configured to extend in a direction inwardly of the side edges of the working zone, such that when in use, particles such as fuzzy cotton seed or debris can be guided away from the side edges of the insert toward a central axis of the outer face by the guiding surface, wherein the guiding surface includes a wall section that protrudes above and/or is recessed below the outer face.

2. The insert according to claim 1, wherein the wall section protrudes to a varying height, or is recessed to a varying depth relative to the outer face of the working zone.

3. The insert according to claim 1, whereby when the insert is mounted to the ginning rib which is itself operatively mounted to a ginning apparatus, the outer face of the insert has a leading portion and a trailing portion relative to a direction of rotation of saws of a ginning apparatus, and the guiding surface of the insert has a wall section disposed between the leading portion and trailing portion so that the particles moving in a direction from the leading portion toward the trailing portion can contact the wall section and be guided away from the side edges.

4. The insert according to claim 3, wherein the wall section has a level that is different to the level of a leading portion.

5. The insert according to claim 3, wherein the wall section is formed by a groove that extends below the leading portion and/or the trailing portion.

6. The insert according to claim 5, wherein the groove has a varying or non-uniform depth relative to either the side edges and/or the leading portion.

7. The insert according to claim 5, wherein the groove has a varying or non-uniform width.

8. The insert according to claim 5, wherein the groove is in the form of a V-shape in which the apex of the V-shape points toward, or terminates at the trailing portion.

9. The insert according to claim 8, wherein diverging legs of the V-shape extend to the side edges on opposite sides of the insert.

10. The insert according to claim 5, wherein the groove has a depth that is equal to, or less than 5 mm.

11. The insert according to claim 5, wherein the groove has a width that is equal to, or less than 10 mm.

12. The insert according to claim 5, wherein the width of the groove reduces in a direction away from the side edges toward a central axis.

13. The insert according to claim 5, wherein the depth of the groove reduces in a direction away from the side edges toward the central axis.

14. he insert according to claim 5, wherein the groove has at least one of: a flat bottom wall, a curved bottom wall, or pointed bottom defined by two walls converging.

15. The insert according to claim 1, wherein the insert includes one or more than one attachment element for removeably fastening the insert to the ginning rib.

16. The insert according to claim 15, wherein the attachment element is in the form of a lug that extends from an underside face of the insert and is received by an opening of the ginning rib when mounted thereto.

17. The insert according to claim 3, wherein at least one of the leading portion and/or trailing portion of the insert is continuous with adjacent sections of the ginning rib when fitted thereto.

18. The insert according to claim 1, wherein the guiding surface defines a depression in the outer face that is spaced from the side edges.

19. A ginning rib for use in a gin stand having rotating saws, cotton lint being separated from cotton seed over a ginning zone, or at a ginning point defined between the ginning rib and the saws, the ginning rib including:

i) an elongate body that can be operatively mounted to the gin stand between adjacent rotating saws of the gin stand; and ii) a working zone that forms part of the elongated body, the working zone having an outer face, side edges, and at least one guiding surface that extends above or below the outer face, the guiding surface is configured to extend in a direction inwardly of the side edges of the working zone, and when the ginning rib is in use, the guiding surface can guide particles such as seed-cotton or fuzzy seed in a direction away from the side edges toward a central region or axis of the ginning rib, wherein the guiding surface includes a wall section that protrudes above and/or is recessed below the outer face of the working zone.

20. The ginning rib according to claim 19, wherein the difference in levels between the wall section and the remainder of the outer face reduces.

21. The ginning rib according to claim 19, wherein the wall section protrudes to a varying height, or is recessed to a varying depth relative to the outer face of the working zone.

22. The ginning rib according to claim 19, whereby when the ginning rib is in use, the working zone of the ginning rib has a leading portion and a trailing portion relative to the direction of rotation saw, and wherein the guiding surface has a wall section that is disposed between the leading and trailing portions and the wall section has a different level to a level of the leading portion such that the particles moving from the leading portion toward the trailing portion can contact the wall section and are guided away from the side edges of the working zone.

23. The ginning rib according to claim 22, wherein the wall section is formed by a groove that extends below the leading portion.

24. The ginning rib according to claim 23, wherein the groove has a varying or non-uniform depth relative to either the side edges and/or the leading portion.

25. The ginning rib according to claim 23, wherein the groove has a varying or non-uniform width.

26. The ginning rib according to claim 23, wherein the groove is in the form of a V-shape in which the apex of the V-shape points toward, or terminates at the trailing portion.

27. The ginning rib according to claim 26, wherein diverging legs of the V-shape extend to the side edges.

28. The ginning rib according to claim 23, wherein the groove reduces in depth relative to the leading portion or the side edges in direction toward a central axis of the ginning rib.

29. The ginning rib according to claim 23, wherein the depth of the groove has a depth that is equal to, or less than 5 mm.

30. The ginning rib according to claim 23, wherein the groove has a width of equal to, or less than 10 mm.

31. The ginning rib according to claim 23, wherein the width of the groove reduces in a direction away from the side edges.

32. The ginning rib according to claim 23, wherein the groove has at least one of: a flat bottom wall, a curved bottom wall, or pointed bottom defined by two walls converging.

33. The ginning rib according to claim 23, wherein the working zone is integrally formed with a body of the ginning rib and at least one of: i) the side edges of the working zone are co-planar with side edges of the ginning rib adjacent to the working zone, ii) the leading portion of the working zone is continuous with an adjacent section of the ginning rib, and iii) the trailing portion of the working zone is continuous with an adjacent section of the ginning rib.

34. The ginning rib according to claim 19, wherein the guiding surface defines a depression in the outer face that is spaced from the side edges.

35. A method of ginning seed-cotton in a ginning apparatus including a frame assembly, a plurality of saws that are rotatably mounted to the frame assembly about a common axis and are spaced from one another in adjacent relationship, and a plurality of ginning ribs of which one is located between some or all of the saws and in which the ginning ribs have a working zone at a high wear region of the ginning rib, the working zone having an outer face and side edges, the outer face of the working zone has one or more guiding surfaces that include a wall section that protrudes above and/or is recessed below the outer face of the working zone and the wall section is configured to extend in a direction inwardly of, or inwardly from, the side edges, and wherein the method includes:

a) feeding seed-cotton onto the saws of the cotton gin;

b) rotating the saws so that cotton lint of the seed-cotton is caught by the saw, and the seed-cotton is pulled toward the ginning rib for removing cotton lint from the seed-cotton;

c) allowing the seed-cotton to engage the guiding surfaces of the ginning ribs which urge the seed-cotton away from the side edges of the ginning ribs; and d) collecting the cotton lint separate from the fuzzy seed.

36. The method according to claim 35, wherein the seed-cotton engages the guiding surfaces and moves in a direction away from the side edges of the working zone while the cotton lint is being removed from the seed-cotton during rotation of the saws.

37. The method according to claim 35, wherein the working zone has a leading portion and a trailing portion relative to the direction of rotation of the saw, and the seed-cotton moves in a direction away from the side edges of the working zone while moving in a direction from the leading portion to the trailing portion.

38. The method according to claim 35, wherein the method includes removing cotton lint from the seed-cotton so that less than 11.1 wt % residual lint remains on the fuzzy seed after one pass through the ginning apparatus.

39. The method according to claim 35, wherein the method includes removing cotton lint from the seed-cotton so that less than 10.5 wt % residual lint remains on the fuzzy seed after one pass through the ginning apparatus.

40. The method according to claim 35, wherein the length of the fibre removed from the seed-cotton has a mean long fibre length of greater than 1.07 inches (2.718 cm).

41. The method according to claim 35, wherein the length of fibre removed from the seed-cotton has a short fibre index of less than 10.9.

42. A method of ginning seed-cotton in a ginning apparatus including a frame assembly, a plurality of saws that are rotatably mounted to the frame assembly about a common axis and are spaced from one another in adjacent relationship, and a plurality of ginning ribs of which one is located between some or all of the saws and in which the ginning ribs have a working zone at a high wear region of the ginning rib, the working zone having an outer face and side edges, the method including:

a) providing the outer face of the working zone with at least one guiding surface that includes a wall section that protrudes above and/or is recessed below the outer face of the working zone and the wall section is configured to extend in a direction inwardly of, or inwardly from, the side edges;

b) feeding seed-cotton onto the saws of the cotton gin;

c) rotating the saws so that cotton lint of the seed-cotton is caught by the saw, and the seed-cotton is pulled toward the ginning rib for removing cotton lint from the seed-cotton; and d) allowing the seed-cotton to engage the guiding surfaces of the ginning ribs which urge the seed-cotton away from the side edges of the ginning ribs.

* * * * *